US007233254B2

(12) United States Patent
Howell

(10) Patent No.: US 7,233,254 B2
(45) Date of Patent: Jun. 19, 2007

(54) LOWERABLE SMOKE DETECTOR

(76) Inventor: Byron H. Howell, 3145 Market Ave., East St. Louis, IL (US) 62207

( * ) Notice: Subject to any disclaimer, the term of this patent is extended or adjusted under 35 U.S.C. 154(b) by 222 days.

(21) Appl. No.: 10/999,245

(22) Filed: Nov. 30, 2004

(65) Prior Publication Data

US 2005/0128094 A1 Jun. 16, 2005

Related U.S. Application Data

(60) Provisional application No. 60/527,251, filed on Dec. 5, 2003.

(51) Int. Cl.
*G08B 17/10* (2006.01)

(52) U.S. Cl. ..... 340/628; 340/630; 340/632; 340/635; 340/691.3; 340/693.6; 340/693.11

(58) Field of Classification Search ..... 340/628, 340/629, 630, 632, 635, 636.1, 691.3, 693.5, 340/693.6, 693.7, 693.11; 248/327, 328, 248/331, 329; 362/402, 403
See application file for complete search history.

(56) References Cited

U.S. PATENT DOCUMENTS 4,372,432 A 2/1983 Waine et al.
4,433,765 A 2/1984 Rude et al.
4,489,308 A * 12/1984 Logan et al. ..... 340/628
4,514,725 A 4/1985 Bristley
4,843,375 A * 6/1989 Riordan ..... 340/550
5,053,752 A 10/1991 Epstein et al.
5,149,038 A 9/1992 VanCleve
5,264,668 A * 11/1993 Rizzo ..... 181/205
5,646,598 A * 7/1997 Nickles et al. ..... 340/628
6,142,439 A * 11/2000 Aramaki ..... 248/327
6,446,926 B1 9/2002 Kaschuk

* cited by examiner

*Primary Examiner*—Hung Nguyen
(74) *Attorney, Agent, or Firm*—Polster, Lieder, Woodruff & Lucchesi

(57) ABSTRACT

A lowered smoke detector is disclosed. It comprises a sensor and a mounting system. The mounting system includes a frame, a securing device, a reel, a flexible member, a mounting adaptor, an activator, and a cover. The frame is mounted to the wall with the securing device to the wall. The reel with the flexible member wound about it and the activator hanging down is attached to the frame. The sensor is mounted to flexible member via mounting adaptor and hooks. Finally, the cover fits over the frame to complete the assembly. The operator pulls the activator in a clockwise or counterclockwise direction to lower or raise the sensor between a raised position for operation and a lowered position for servicing.

20 Claims, 2 Drawing Sheets

LOWERABLE SMOKE DETECTOR

CROSS-REFERENCE TO RELATED APPLICATIONS

This application claims the benefit of U.S. Provisional Application 60/527,251 filed Dec. 5, 2003, incorporated by reference herein.

STATEMENT REGARDING FEDERALLY SPONSORED RESEARCH

Not Applicable.

BACKGROUND OF THE INVENTION

This invention relates to devices for easily lowering a smoke detector or other sensor, such as a heat or ionization detector, from a position near a ceiling to a position at which it is more easily inspected or serviced.

Smoke detectors are widely used, but seldom serviced. Typically, a smoke detector includes a sensor, an alarm triggered by the sensor, a power source, and a testing button for activating the alarm independent of the sensor. Smoke detectors must be placed on or near a ceiling of a building, but not too near the junction of the ceiling and a wall. Smoke detectors require periodic inspection and testing. Battery-powered smoke detectors, in particular, require periodic replacement of their batteries. Unfortunately, the location of the typical smoke detector makes it difficult to reach.

BRIEF SUMMARY OF THE INVENTION

Briefly stated, the invention is a combination sensor with a supporting mounting system. The mounting system moves the sensor from a raised position for operation to a lowered position for examining or servicing. The mounting system includes a reel and a flexible member wound around the reel for supporting the sensor.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

Figure 1:
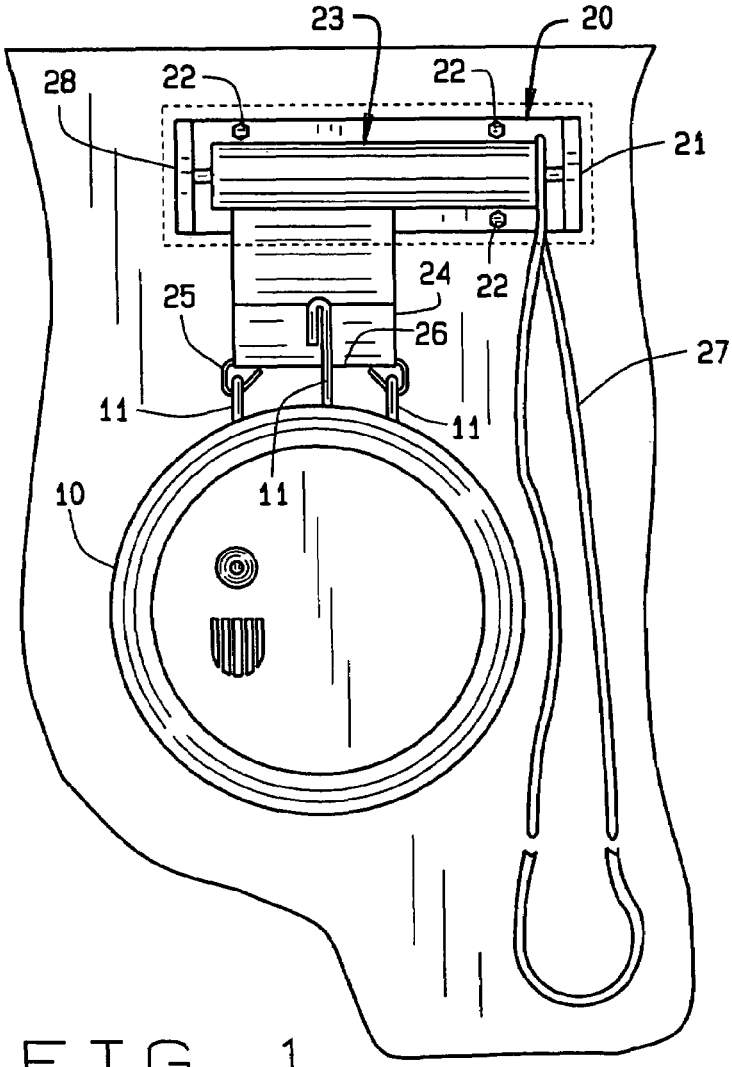
FIG. 1 is a front view of an illustrative embodiment of a lowerable smoke detector of the present invention in a raised position.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

FIGS. 1-4 show one illustrative embodiment of a smoke detector in an operative position. The smoke detector includes a sensor 10 and a mounting system 20. The sensor 10 includes hooks 11 for securing to the mounting system 20. The sensor 10 conventionally includes at least a power source, such as a battery 12, a smoke detecting element 13, an alarm 14, a test button 15, and a housing 16, 17. However, additional elements may be included.

Figure 2:
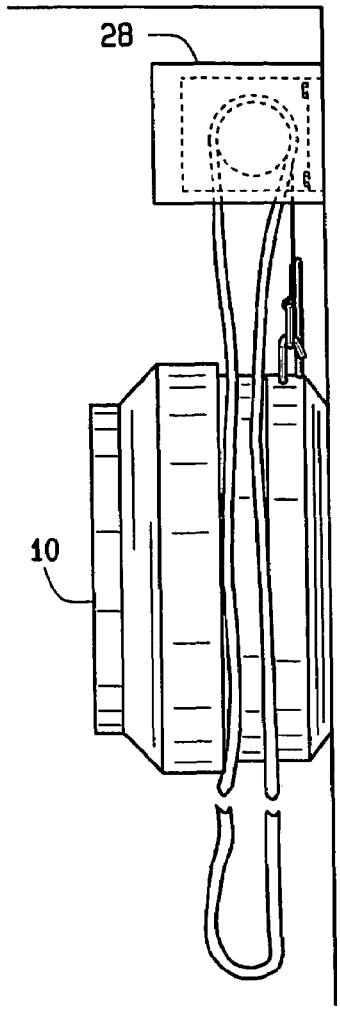
FIG. 2 is a side view of the embodiment of FIG. 1 in the raised position.
Figure 3:
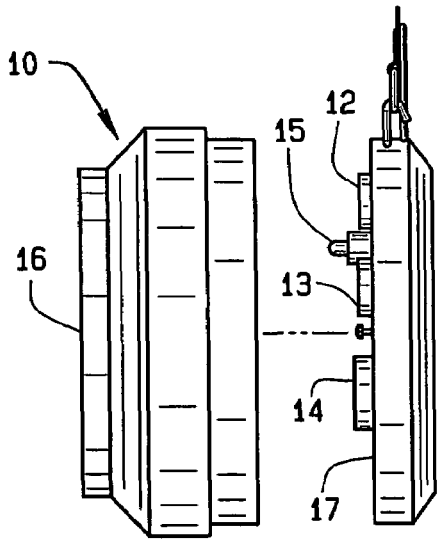
FIG. 3 is a side view of the sensor portion of the embodiment of FIGS. 1 and 2.

Referring to FIGS. 1 and 2, the mounting system 20 includes a frame 21, a securing device 22, a reel 23, a flexible member 24, a mounting adaptor 25, an activator 27, and a cover 28. The frame 21 is a generally U-shaped bracket that mounts to a wall 30 using the securing device 22, shown as a set of bolts. Building and Fire Codes largely determine the location of the frame 21 on the wall 30. Generally, when mounted on the wall 30 the sensor 10 is to be no more than 4"-12" from a ceiling 31 during operation. It will be seen that the construction and dimensions of the mounting system 20 assures that the sensor 10 is properly spaced from the ceiling. In addition, the sensor 10 is usually required to be a specified distance away from any corners during operation.

Figure 4:
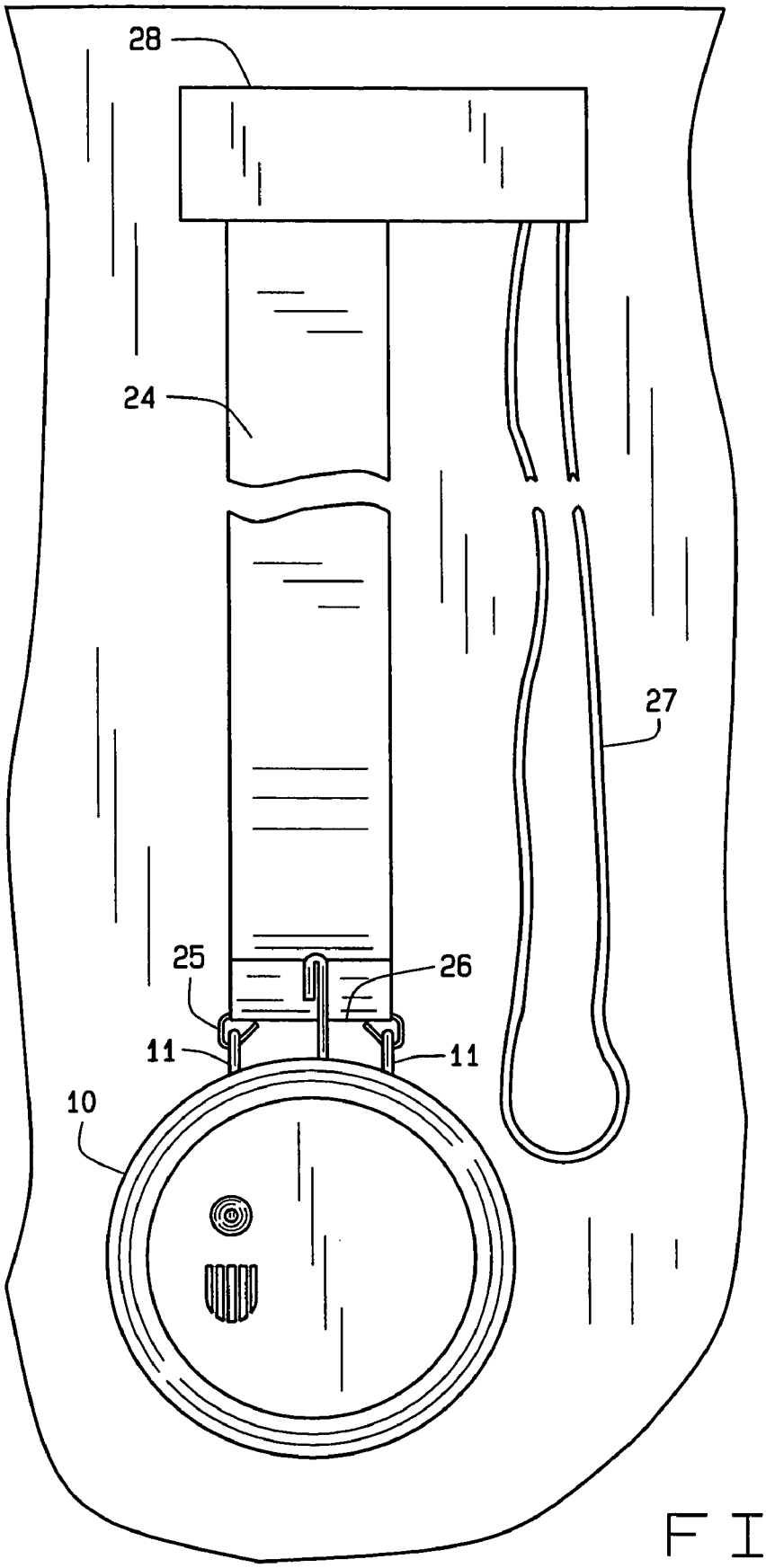
FIG. 4 is a front view of the embodiment in a lowered position.

FIG. 1 depicts the reel 23 as a window shade reel, such as one sold by General Clutch Corporation under the trademark as Rollease and disclosed in U.S. Pat. No. 4,372,432 and U.S. Pat. No. 4,433,765, hereby incorporated by reference. The flexible member 24 is a flat and flexible sheet, such as a window shade, that is wound around the reel 23. The flexible member 24 includes the mounting adaptor 25 at a bottom edge 26. The hooks 11 of the sensor 10 secure to the mounting adaptor 25. The activator 27 is a loop of beads that engages the reel 23 and it hangs down from the reel. A lower end of the loop perfectly extends to within 60"-80" from the floor. When an operator pulls on the activator 27 in a clockwise or counterclockwise direction, the reel 23 winds and unwinds the flexible member 24, which in turn moves the sensor 10 between a raised position (FIGS. 1 and 2) to a lowered position (FIG. 4). In the raised position shown in FIG. 1, the sensor 10 is at the appropriate distance from the ceiling 31 to meet code requirements and insure proper operation. As shown in FIG. 4, in the lowered position the sensor 10 is low enough to be easily accessed without the aid of a ladder or step stool. In this position, the sensor 10 can be accessed for testing and replacement of batteries. Finally, the cover 28 fits over the frame 21 and the reel 23 to provide an overall clean aesthetic appearance.

In operation, the frame 21 is mounted to the wall 30 with the securing device 22 at a specified distance from the ceiling 31. Next, the reel 23 with the flexible member 24 wound about it and the activator hanging down is attached to the frame 21. Then, the sensor 10 is mounted to flexible member 24 via the mounting adaptor 25 and hooks 11. Finally, the cover 28 fits over the frame to complete the assembly. When the sensor 10 is in the raised position as shown in FIG. 1, the operator pulls the activator 27 in a counterclockwise direction to lower the sensor to the lowered position shown in FIG. 4. When the sensor 10 is in the lowered position as shown in FIG. 4, the operator pulls the activator 27 in a clockwise direction to raise the sensor to the raised position shown in FIG. 1.

As various changes could be made in the above constructions without departing from the scope of the invention, it is intended that all matter contained in the above description or shown in the accompanying drawings shall be interpreted as illustrative and not in a limiting sense. For example, rather than a smoke detector that alarms the occupants of a dwelling about the presence of smoke, other types of sensors for detecting other conditions such as, natural gas, carbon monoxide, or radon could also be used. Other types of reels could be used. Other types of securing and mounting could be used, such as screws or adhesives. Other types of flexible members could be used, such as fishing line or string. The reel could be mounted within reach of a user and operated directly, particularly if a pulley is located near the ceiling. The sensor could be located slideably on a wall-mounted support, rather than hanging free. A simple loop could be provided on the sensor, and a pole (either fixed or extendible) utilized to engage the loop and lower the sensor. The appearance of the device could be simplified by cutting the body of a round sensor housing with a horizontal chord to form an upper segment that houses the reel and a lower segment that houses the sensor; in this embodiment, when the lower segment is raised to its operative position, the entire device resembles a simple disk-shaped smoke detector.

In another variation, the sensor could be mounted to the mounting system so that only the necessary parts are lowered. For instance, the smoke detecting element and alarm could be fixedly mounted within the mounting system while only the power source and test button are accessible in the lowered position. In this embodiment the smoke detecting element and alarm remain in the raised position to detect and alert the presence of smoke. However, the power source and test button can be lowered so that the user may refresh the power source or test the alarm using the test button. These variations are merely illustrative.

The invention claimed is:

1. In combination, a sensor and a mounting system for supporting the sensor on a wall at a raised position near a ceiling and at a lowered position for examining or servicing the sensor, the mounting system comprising a reel mounted on the wall and a flexible member wound around the reel in at least one position of the sensor, the flexible member supporting the sensor.

2. The combination of claim 1 further comprising a mounting adapter carried by the flexible member, the sensor being mounted to the mounting adapter.

3. The combination of claim 1 wherein the flexible member comprises a flexible sheet.

4. The combination of claim 1 further comprising an activator for operating the reel independent of the flexible member.

5. The combination of claim 4 wherein the activator comprises a depending loop physically engaging the reel, the loop being manually manipulable from below the mounting system.

6. The combination of claim 1 further comprising a frame carrying the reel, and at least one securing device for securing the frame to the wall.

7. The combination of claim 6 wherein the securing device is selected from the group consisting of screws, bolts, and adhesives.

8. The combination of claim 1 further comprising a cover for housing the mounting system.

9. The combination of claim 1 wherein the sensor comprises a battery.

10. The combination of claim 1 wherein the sensor is a smoke detector, the smoke detector further comprising an alarm operatively connected to the sensor.

11. A method of mounting a smoke alarm in a building having at least one wall and a ceiling, the method comprising mounting a support structure in the building, the support structure including a reel having an axis of rotation fixed with respect to the ceiling, and thereafter using the reel to move the smoke alarm between a raised position near the ceiling to a second position lowered from the ceiling.

12. The method of claim 10 wherein the smoke detector is mounted to the support structure after the support structure is mounted to a wall.

13. An easily serviced smoke alarm comprising a sensor unit including a replaceable battery and a mounting system for supporting at least the replaceable battery at a raised position near a ceiling and at a lowered position for replacing the battery, the mounting system comprising a reel and a flexible member wound around the reel in at least one position of the sensor, the flexible member supporting the battery and permitting moving the battery from below from its raised position to its lowered position independent of the state of the battery.

14. The alarm of claim 13 wherein the battery and at least a smoke sensor are supported by the flexible member.

15. The alarm of claim 13 further comprising a mounting adapter carried by the flexible member, the battery and sensor being mounted to the mounting adapter.

16. The alarm of claim 13 wherein the flexible member Comprises a flexible sheet.

17. The alarm of claim 13 further comprising an activator for operating the reel independent of the flexible member.

18. The alarm of claim 13 wherein the activator comprises a depending loop physically engaging the reel.

19. The alarm of claim 13 further comprising a frame carrying the reel, and at least one Securing device for securing the frame to a wall or ceiling.

20. The alarm of claim 13 wherein the battery and at least a signal producing device are supported by the flexible member.

* * * * *